US005214402A

United States Patent [19]

DiVincenzo et al.

[11] Patent Number: 5,214,402

[45] Date of Patent: May 25, 1993

[54] TRIP LINK LATCH AND INTERPOLE LINK FOR A CIRCUIT BREAKER

[75] Inventors: Gregory T. DiVincenzo, Easton; John C. Lucas, Salisbury; Keith A. Singer, Cambridge, all of Md.

[73] Assignee: North American Philips Corporation, New York, N.Y.

[21] Appl. No.: 814,975

[22] Filed: Dec. 23, 1991

[51] Int. Cl.[5] ..... H01H 9/20

[52] U.S. Cl. ..... 335/167; 335/23

[58] Field of Search ..... 335/23-25, 335/167-176

[56] References Cited

U.S. PATENT DOCUMENTS 3,467,920 9/1969 Hall et al. ..... 335/172

4,276,526 6/1981 Ciarcia et al. ..... 335/35

*Primary Examiner*—Lincoln Donovan

*Attorney, Agent, or Firm*—David R. Treacy

[57] ABSTRACT

Tripping of the poles of a multi-pole breaker requires less force from current sensing actuators, through use of a lost motion linkage including a trip link which unlatches the linkage holding one pole contact set closed before operating the inter-pole tripping elements. Preferably the breaker has a fast forcing arrangement for forcing a movable contact open under short-circuit conditions, faster than the normal contact opening spring can respond. The lost motion linkage is provided by a trip link which first releases a secondary latch to permit contact opening at normal speed, and then operates an inter-pole tripping element. Under short-circuit conditions the trip link engages the movable contact to force it open, between unlatching and engagement of the inter-pole tripping element.

8 Claims, 9 Drawing Sheets

FIG. 7
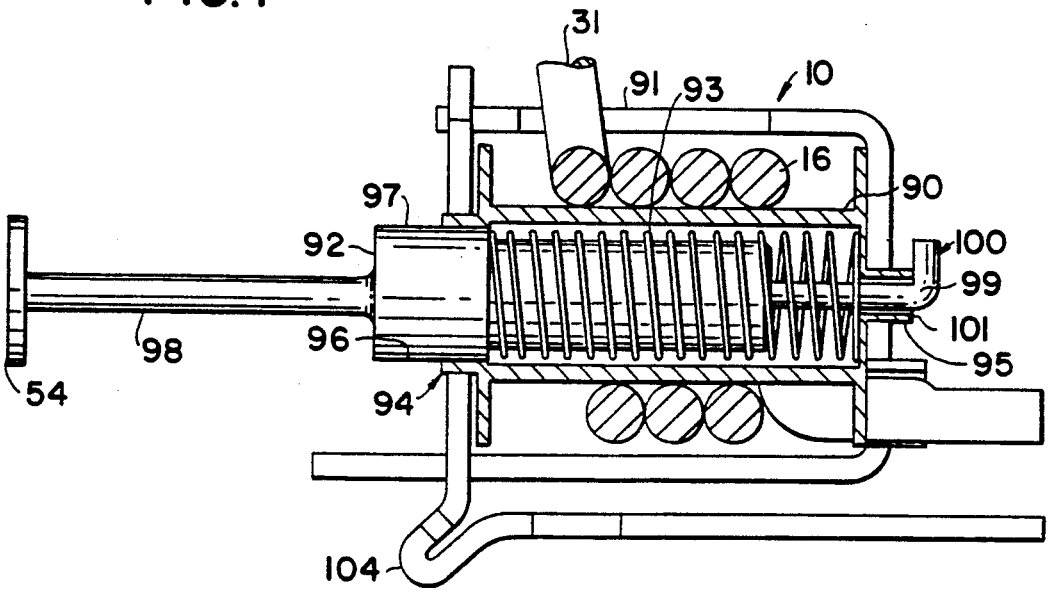
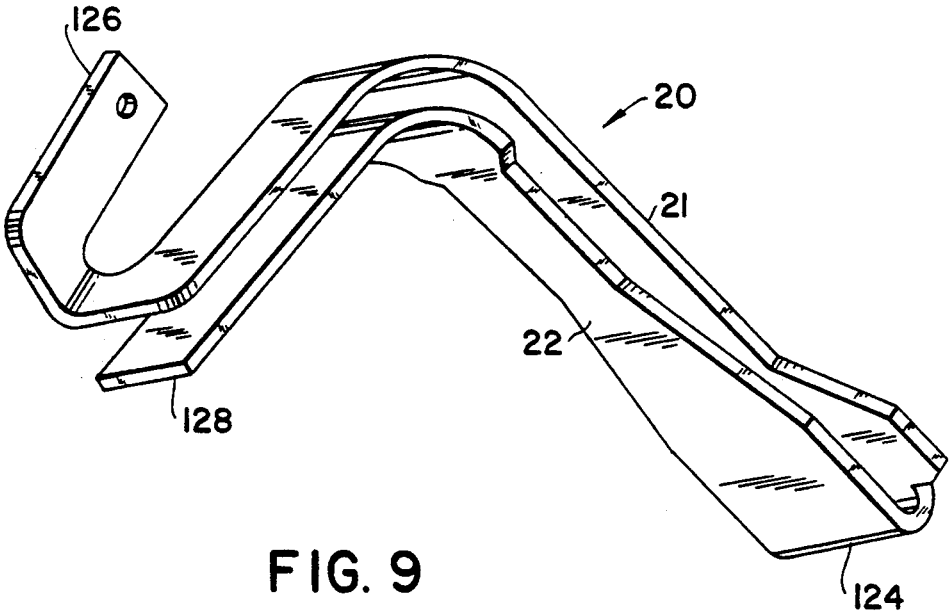
FIG. 9

TRIP LINK LATCH AND INTERPOLE LINK FOR A CIRCUIT BREAKER

CROSS-REFERENCE TO RELATED APPLICATIONS

This application is one of three concurrently-filed applications disclosing common subject matter but claiming different inventions. The others are Magnetic Blow-out Circuit Breaker with Booster Loop Arc Runner, by Gregory T. DiVincenzo; and Adjustable Magnetic Tripping Device and Circuit Breaker Including Such Device by Gregory T. DiVincenzo and Richard Collevechio.

BACKGROUND OF THE INVENTION

The invention relates to the field of electrical circuit breakers; and in particular to multi-pole circuit breakers having fault current limiting capabilities.

In the design of circuit breakers of this type, compromises are required between various goals. The breaker should be compact, fast operating, have accurate and repeatable trip levels, and high current interruption capability. To accomplish all these goals, mechanisms have been made which become increasingly complex, and may include many relatively long fingers and levers.

U.S. Pat. No. 4,276,526 discloses a miniature circuit breaker which has a normal contact opening mode using spring force, and a fast opening mode using a solenoid first to unlatch the contact mechanism, and then to force the contacts apart. The resulting mechanism is quite complex.

U.S. Pat. No. 4,636,760 discloses a breaker mechanism which allows remote operation by one solenoid, thermal tripping, and magnetic tripping by another solenoid. As a result this mechanism is also complex, with a number of long elements required for operation.

SUMMARY OF THE INVENTION

An object of the invention is to permit tripping of a breaker which requires very low tripping force while still allowing for reliable inter-pole tripping.

Another object of the invention is to permit forced fast contact opening, with reliable continued separation of the contacts after the fault current has been reduced or the arc extinguished.

A further object of the invention is to permit a very compact design while having high voltage and current interrupting ratings.

According to the invention, the tripping mechanism for a breaker includes a pivotal trip link which has a sensing arm arranged to be engaged by thermal and/or magnetic sensors; a latching surface for a contact latch mechanism; and projections for engaging inter-pole tripping elements of adjoining poles. By forming the trip link of a high strength synthetic resin "plastic" material the high voltage breakdown between adjoining poles sections can be maintained in a compact breaker; while by using short pivoting elements, the operating speed and reliability of the breaker can be enhanced.

To allow forced fast opening of contacts under short-circuit conditions, the sensing arm can be arranged so that, after unlatching surfaces near a hub of the trip link have unlatched, further movement of the sensing arm engages a movable contact arm to force it open before the normal mechanism spring will have overcome inertia and other loads sufficiently to separate the contacts fully.

According to another aspect of the invention, the trip link, contact arm and other parts are arranged such that a contact pressure spring applied torque in one direction, to press the contacts together, under normal conditions; but during fast forced contact opening by direct solenoid impact, the pressure spring slips into engagement with a different part of the contact arm so that the arm is held open until the rest of the mechanism finishes its movements.

According to still another aspect of the invention, the inter-pole tripping elements and devices form part of the hub of the trip link. This minimizes the parts count and the inertia which must be overcome during tripping due to an overload.

BRIEF DESCRIPTION OF THE DRAWING

FIG. 7 is a layout of the magnetic tripping solenoid of FIG. 1, FIG. 9 is a perspective view of the booster loop element at an enlarged scale.

DESCRIPTION OF THE PREFERRED EMBODIMENT

Overall construction and operation

Figure 1:
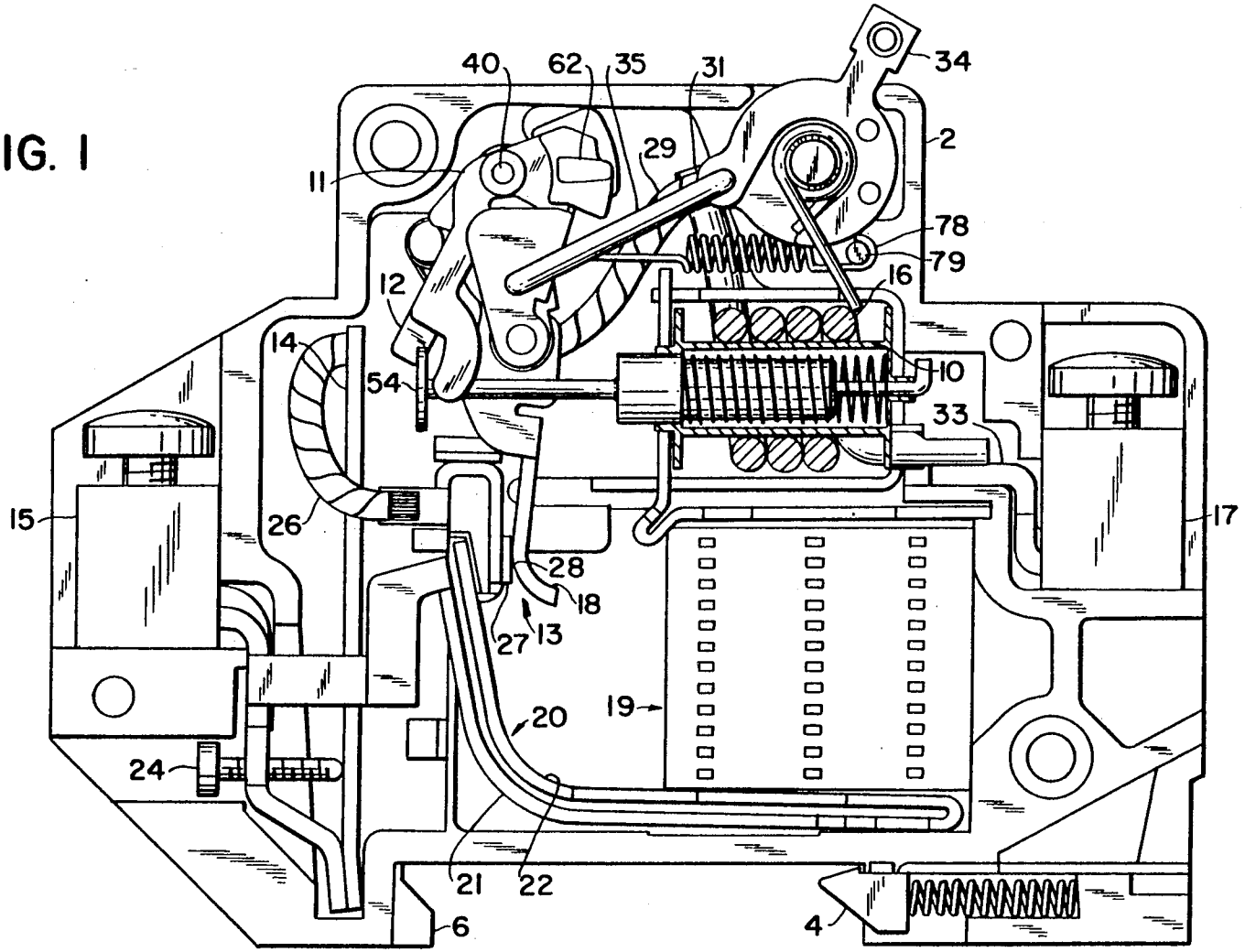
FIG. 1 is a simplified layout of the principal parts of a magnetic blow-out circuit breaker according to the invention.

A multi-pole circuit breaker, one pole of which is shown in FIG. 1, is contained and mounted in an insulating housing 2 having conventional external snap-in mounting elements 4 and 6. The breaker includes a magnetic tripping solenoid 10 for tripping a trip link latch and multi-pole link mechanism 11 which incorporates a novel trip link element 12. The trip link 12 is tripped to open a contact set 13 upon sensing a relatively high overload current carried from the line terminal connection 15 through a bi-metal strip or element 14, the contact set 13, and the coil 16 of the solenoid 10, to a load terminal connection 17.

The same contact set is opened as a result of movement of the bi-metal strip 14 if the breaker has been carrying a small overload current for a relatively long period of time.

Upon counterclockwise pivoting of the trip link 12, the other parts of the mechanism 11 release the latch for a movable contact arm 18 which pivots counterclockwise to open the contact set 13. The current flow which is to be interrupted will, immediately after contact opening, flow across the gap between the contacts of the set. Magnetic forces cause the arc to be moved toward an arc chute 19. As soon as the arc has been spread and moved (downwards as viewed in FIG. 7) one end of the arc transfers to the arc runner and booster loop 20, current traveling from line terminal connection 15 flows down a booster loop portion 21 and back up the arc runner portion 22 to the spot to which the arc has transferred. Magnetic forces cause the arc to be stretched and move toward the arc chute 19, the arc being so stretched when it enters the chute that it is extinguished.

Other elements shown in FIG. 1 are generally typical of those known in the art. The bi-metal strip 14 has its cold position adjusted by a screw 24 which permits calibration of the long-term current trip setting. Current flowing through the bi-metal strip is carried by a multi-strand flexible wire strap 26 to the fixed contact 27. Current from a movable contact 28 on the contact arm 18 is carried over multi-strand flexible strap 29 to one end 31 of the solenoid coil 16. The other end of the solenoid coil 16 is connected by a relatively rigid conductor 33 to the load terminal connection 17.

A handle 34 connected to a handle link 35 is used to open, close, and reset the movable contact 18 via the mechanism 11.

The contact latching and unlatching mechanism

The mechanism 11 and its parts are shown in FIGS. 2–6. The movable contact arm 18 is pivotably mounted on a latch and contact pivot pin 36 which is fixed in a crank 38 which, in turn, is pivotable mounted on a mechanism pivot pin 40 fixed to the frame 2 of the breaker. The pivot pin 36 also supports a pivotable latch 42 to which the handle link 35 is connected. The functional interconnection of the crank, latch and contact arm will be described below with respect to FIGS. 2–5 which show stages in tripping of the breaker.

Figure 6:
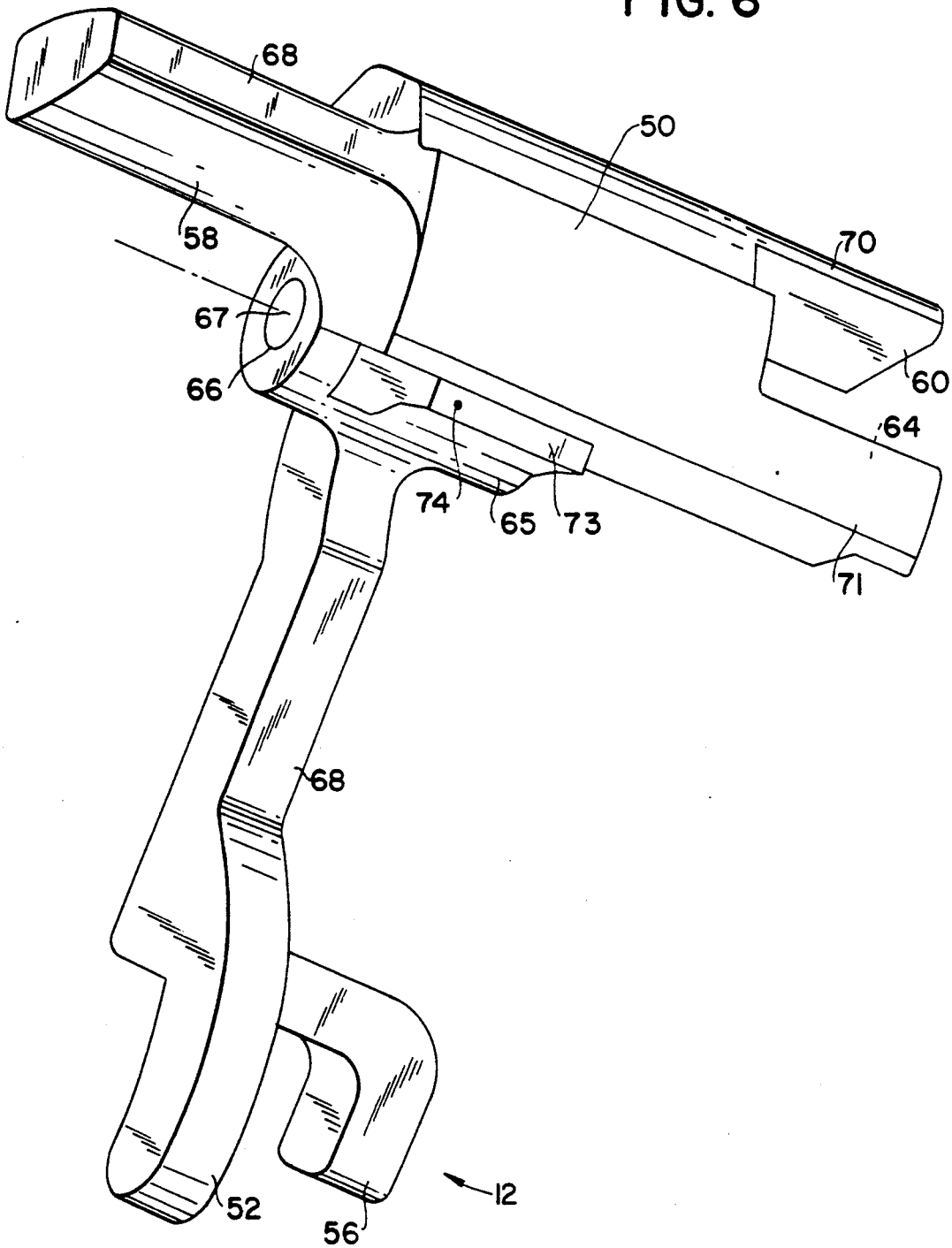
FIG. 6 is an oblique view of the trip link/interpole element at an enlarged scale.

The trip link 12, shown in detail in FIG. 6, is the major interconnecting element between the momentary overload magnetic trip solenoid 10, the long-term overload bi-metal strip 14, and latching parts of each of the poles of the breaker. Before describing its structure in detail, we will summarize its functions so that the structural relationships will be more meaningful. The following description treats the link 12 shown as though it is part of the middle pole mechanism of a 3-pole breaker, the three poles and their mechanisms being substantially identical.

Figure 6A:
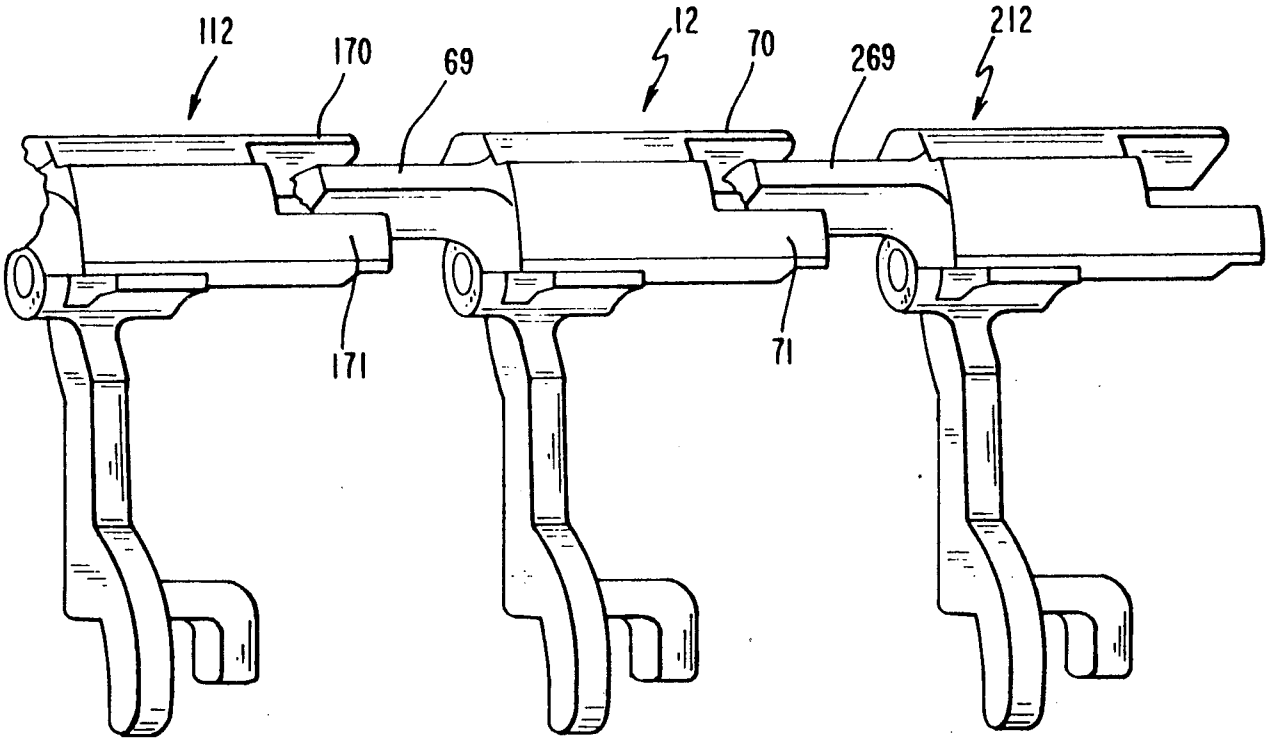
FIG. 6A is a diagrammatic view showing the interlocked trip links of a three pole breaker according to the invention.

The trip link may be operated to unlatch the parts for the movable contact arm 18 of this pole in any of three ways: striking of a finger 52 by an actuating disc 54 of the solenoid 10 of this pole; pushing of a finger 56 by the end of the bi-metal strip 14 of this pole; or contact of one of the inter-pole actuating surfaces 58 and 60 by a trip link of an adjacent pole of the same breaker (see FIG. 6A). If, this trip link is pivoted as a result of any of those occurrences, after unlatching the movable contact 18 of this pole it will operate either or both of the adjacent poles, in sequence, such that all poles are tripped, via contact of the surface 62 (shown in FIG. 1) or the surface 64 (obscured in FIG. 6) which faces surface 60 with respective corresponding surfaces 58 or 60 of the adjoining pole units.

The trip link 12 is preferably molded as one piece of a reinforced synthetic resin material having excellent insulating properties, such as 15% polyester glass having short fibers. This is the only part extending between adjacent poles, so that such construction increases the high voltage isolation between the breaker pole assemblies. The link 12 has a center hub 65 surrounding a pivot mounting hole 66 which defines a pivot axis 67, for mounting over the mechanism pivot pin 40. A relatively long sensing arm 68 extends generally radially from the hub 65, and terminates in the fingers 52 and 56. These fingers are preferably offset from each other both angularly and axially, so that the actuating disc 54 and the bi-metal element 14 may be arranged to have non-overlapping paths of movement.

An adjoining-pole operating projection 69, on which the surfaces 58 and 62 are formed, extends axially in one direction from an operating arm 50 extending generally axially from the hub 65, at an average radius distance from the axis 67 much less than the length of the sensing arm 68; and at the opposite end of the operating arm 50 two operating projections 70 and 71 extend axially, separated by a space substantially wider angularly than the angular width of the projection 69, the facing surfaces 60 and 64 being formed on the respective projections 70 and 71.

A latching surface 73 is formed near the root of the sensing arm 68, the surface 73 being generally circularly cylindrical about the axis 67. For the advantages to be described later with respect to detailed operation, the trip link 12 is proportioned such that its center of gravity 74 falls near the axis 67, generally in line axially with the fingers 52 and 56.

As shown in FIGS. 2–5, the crank 38 and trip link 12 are pivoted, axially adjoining each other, on the mechanism pivot pin 40. A latch and contact pivot pin 36 interconnects the contact arm 18, crank 38 and latch 42, the pin 36 being fixed optionally to one of these elements, and pivotally journalled in the other two. The latch 42 has a latching projection 76 extending radially with respect to the pivot 36, which in the closed contact position shown in FIG. 2 presses against the latching surface 73 of the trip link 12 to form a secondary latch.

Preferably, the latch 42 and the crank 38 are U-shaped metal stampings as viewed from their respective pivots, with the open end of each "U" facing away from the handle 34. The sensing arm 68 of the trip link 12 is aligned so it can pass between the legs of the latch 42, and the contact arm 18 is arranged between the legs of the crank 38. A mechanism spring 78 is stretched between a pin 79 fixed to the housing 2 and an opening 80 in the crank 38 (shown in FIG. 5) to pull the crank in a direction toward the solenoid 10.

Figure 2:
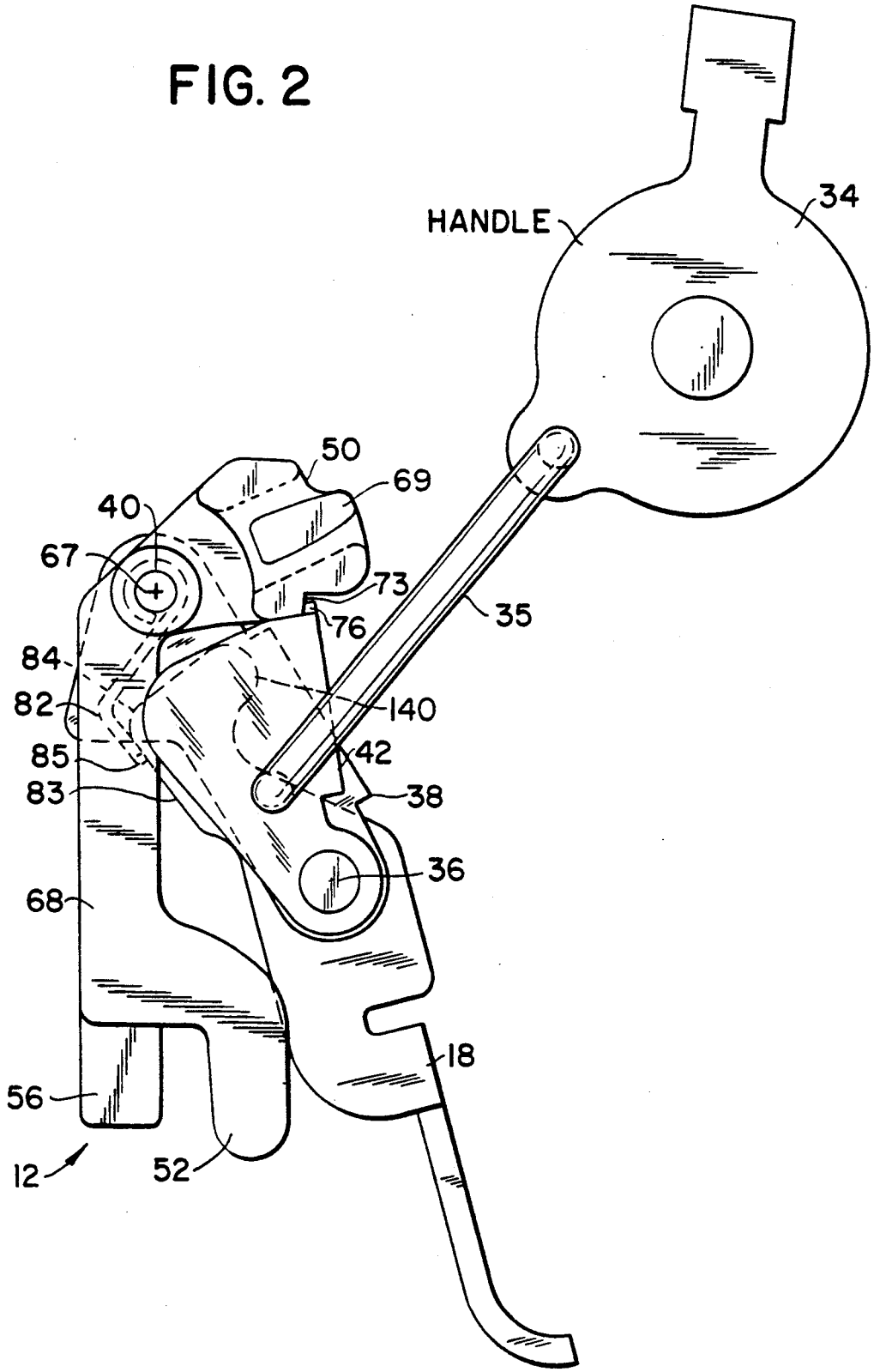
FIG. 2 is a diagrammatic view of the contact and latch mechanism of the breaker of FIG. 1 in the closed position.

As shown in FIG. 2, in the contact closed position an end 85 of a contact pressure spring 82, extending from the mechanism pivot pin 40, bears against a side edge 83 of the contact arm 18, urging the contact arm in a clockwise direction about the pivot pin 36 to provide proper pressure between the movable contact 28 and the fixed contact 27. As will be explained below, in the initially tripped position shown in FIG. 5 the spring 82 bears against an end edge 84 of the contact arm 18, tending to urge the arm 18 counterclockwise so as to hold the contacts open.

A trip link spring (not shown) urges the trip link 12 in a clockwise direction about the pin 40 at all times.

Adjustable solenoid

As shown in FIG. 7, the solenoid 10 is a subassembly having five principal parts: a coil 16, an insulating bobbin 90, a soft magnetic steel frame 91, an armature 92, and a spring 93. The bobbin is hollow, to provide room for the armature 92 and spring 93, and has two coaxial end extensions 94 and 95. The front extension 94 fits within an opening 96 in the frame 91. This opening concentrates the magnetic field in the region within and adjacent to the opening, while the plastic material of the bobbin extension forms a bearing journal for the largest diameter part 97 of the main portion of the armature 92 which extends through the opening 96. The coil 16 and armature 92 can therefore be completely insulated from each other and the solenoid frame 2.

An armature extension 98 extends axially away from the large diameter part 97 to the actuating disc 54. At the other end of the armature main portion a stop rod 99 passes through the extension 95, preferably with a loose fit. An end portion 100 of the stop rod is bent sharply at least obliquely, and preferably about 90° away from the armature and bobbin axis, to bear against the outer end 101 of the extension 95. The compression spring 93 is captured between the largest diameter part 97 of the armature and the rear end of the bobbin adjacent the extension 95.

At least the stop rod portion of the armature is made from a plastically deformable material, so that the bend between the end portion 100 can be formed at a location along the stop rod selected to control the static position of the large diameter portions of the armature with respect to the opening 96 in the frame 2. The length of the stop rod between the bend and the armature main portion therefore determines the magnitude of current required to overcome the force of the spring 93, so that the momentary current trip level can be adjusted accurately after the solenoid has been assembled, without need for selecting and trimming springs.

It is convenient to bend a corner 104 of the solenoid frame 2 outward to form a stop for the movable contact arm 18.

Booster Loop and Arc Runner

Figure 8:
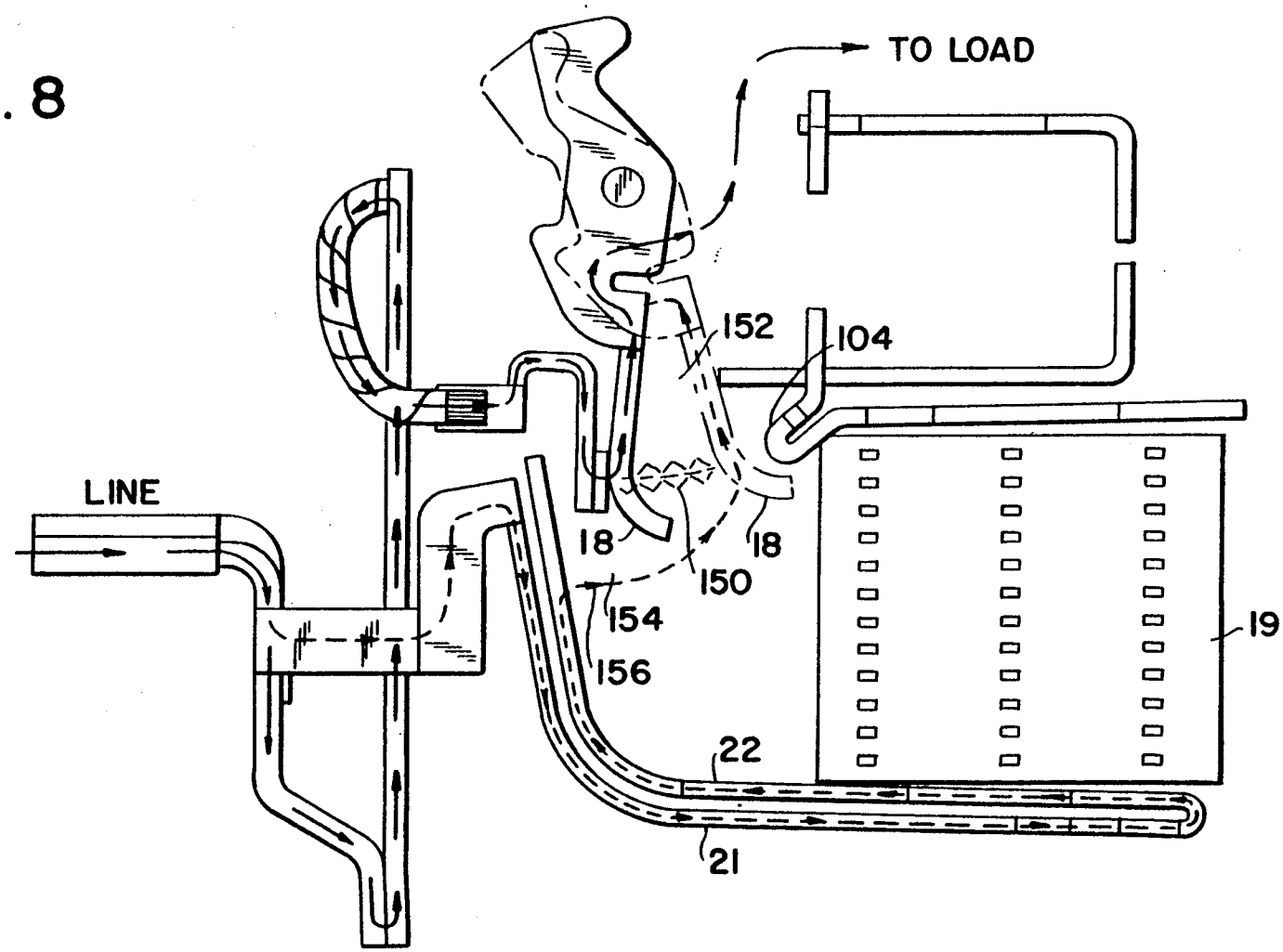
FIG. 8 is diagrammatic view of the booster loop and arc cavity of the embodiment of FIG. 1.

The configuration and current flow patterns of the arc blow-out parts of the breaker are shown in FIG. 8, while the rigid conducting element forming the booster loop and arc runner 20 is shown magnified in FIG. 9.

The rigid booster loop and arc runner 20 is stamped and bent from one piece of hard copper, folded over so that one end 124 fits between the arc chute 19 and the rear wall of the breaker housing 2, the end 124 being adjacent the rear (in the direction of arc blow-out) end of the chute 19. The other end 126 of the booster loop portion 21 is bent for convenience to attach directly to the line terminal connection 15. Except for the bent end 126, the booster loop 21, including the region of it adjacent the end 124, is parallel to the arc runner 22. This not only permits a very compact construction but, as described below, provides a performance advantage because the arc is accelerated faster into the arc chute.

The other end 128 of the arc runner 22 is fixed adjacent, but insulated from, the fixed contact 27. As shown in FIG. 8, The contacts, solenoid and arc runner are arranged such that, immediately after the contacts are separated, the fixed-contact end of the arc between the contacts transfers to the arc runner and, as will be described below, moves down the runner until the arc is extinguished.

Circuit Breaker Operation—Slow Tripping

Tripping operation initiated by this pole is as follows: starting, from the position shown in FIG. 2, either finger 52 or 56 is contacted by the relevant trip unit, pivoting the trip link 12 counterclockwise as seen in FIG. 1-5. When the latching surface 73 has slipped past the latching projection 76 of the latch 42, the latch begins to pivot counterclockwise about the handle link 35 as the crank is accelerated counterclockwise about the mechanism pivot pin 40 as a result of the force applied by the mechanism spring 78 to the crank 38.

Figure 3:
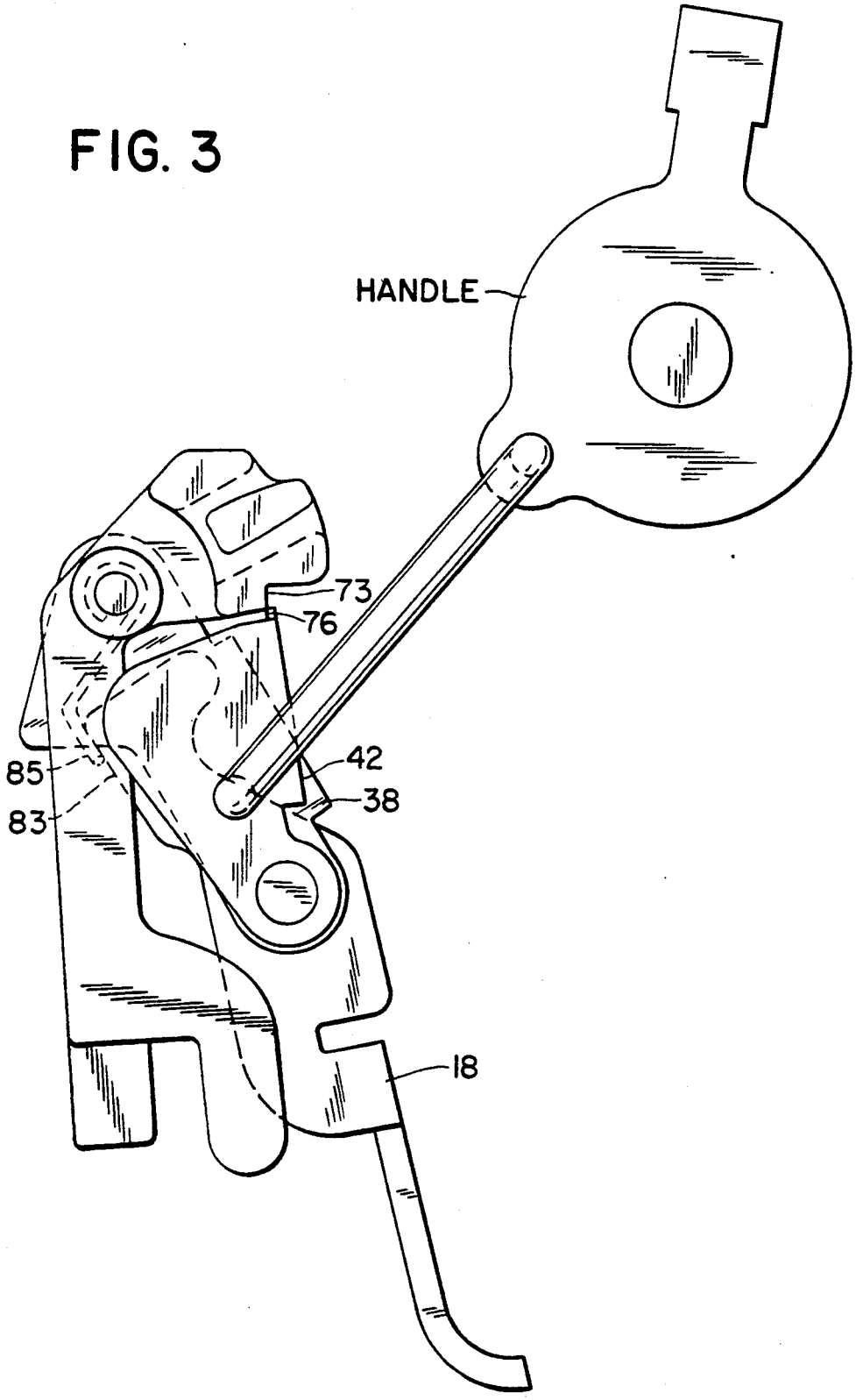
FIG. 3 is a view similar to FIG. 2 but with the mechanism at the trip point.
Figure 4:
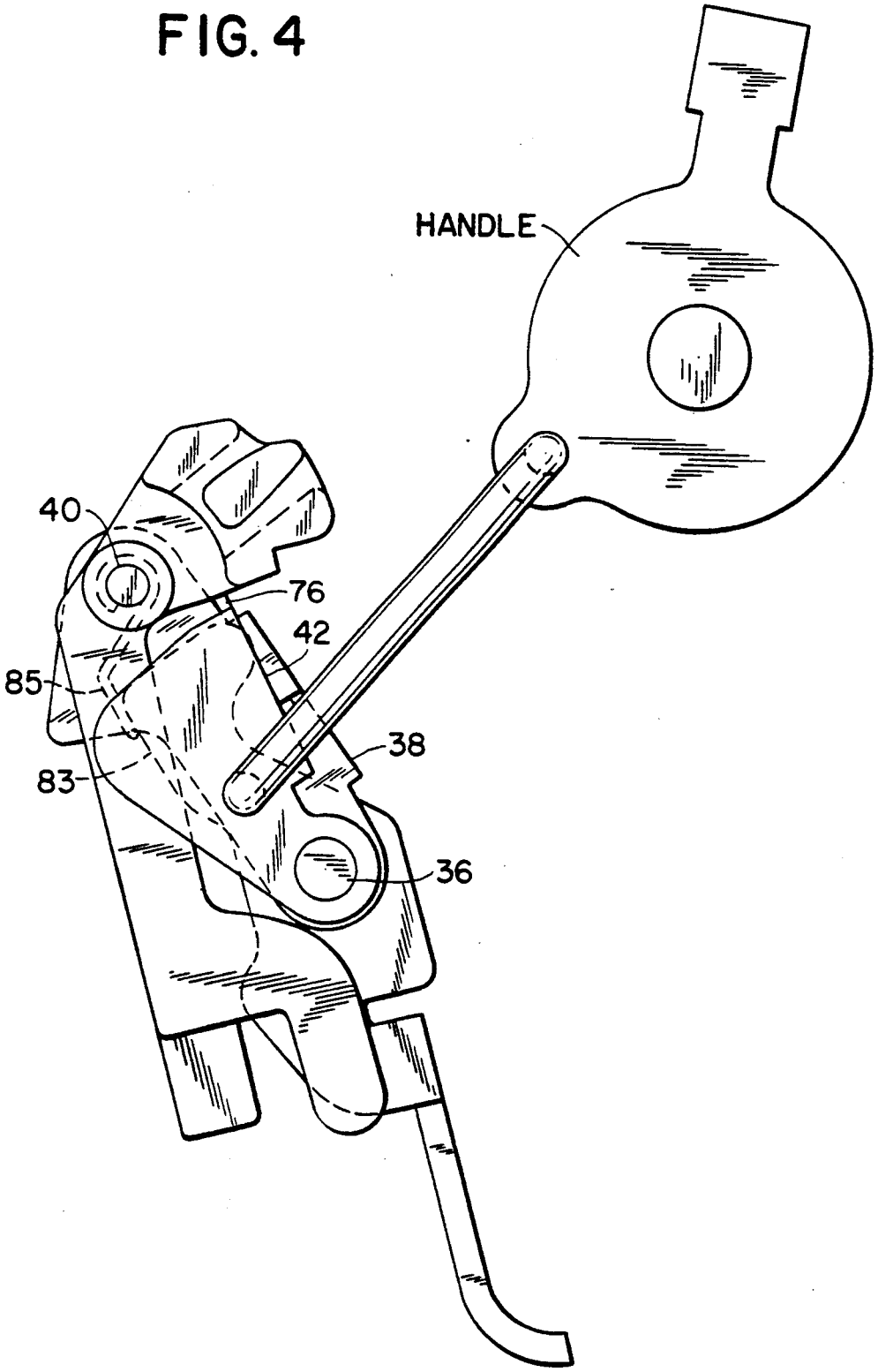
FIG. 4 is a view similar to FIG. 2 but with the mechanism latch at mid-travel.
Figure 5:
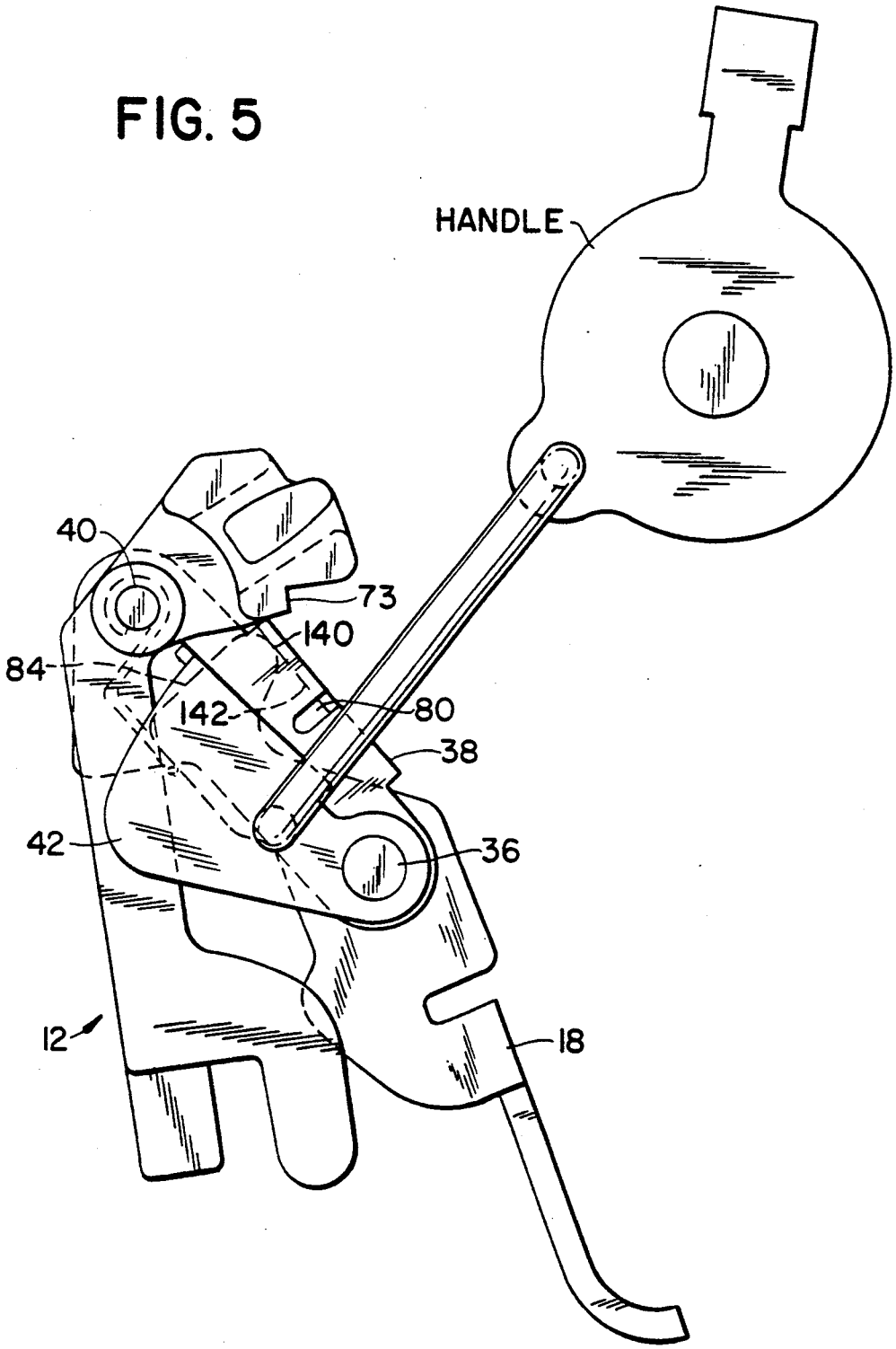
FIG. 5 is a view similar to FIG. 2 but with inter-pole trip completed.

If tripping was caused by movement of the bi-metal strip 14, or rotation of the trip link by an adjoining pole, the contacts are opened rapidly due to the rotation of the crank 38 from the position shown in FIG. 3 to the position shown in FIG. 5. As the crank pin 38 pivots, a nose 140 opposite the side edge 83 of the movable contact arm 18 abuts the inner surface 142 of the base of the "U" of the crank 38, forcing the contact arm then to pivot counterclockwise with the crank, and opening the contact set. At the same time, movement of the end of the contact arm near the mechanism pivot pin 40 causes the end 85 of the contact pressure spring 82 to slide along the side edge 83 to its end, and then to bear against the end edge 84 of the contact arm. This causes the pivoting torque due to the contact pressure spring to reverse, so that this also urges the contacts open.

The release of the latching force on the latch 42 removes the reaction force on the handle link 35. This allows the relatively weak handle spring (not shown) to rotate the handle counterclockwise past dead center of the link-to-handle-pivot line, so that the handle pivots to the open position. This provides a visual indication of the state of the breaker, and also pulls the latch 42 clockwise to the position for resetting. In that position, the end edge 84 of the contact arm 18 has moved so far that the contact pressure spring end 85 slides back from the end edge 84 to the side edge 83. As soon as the tripping force applied to the trip link has been removed, a weak trip link spring (not shown) pivots the trip link back to its normal position, with the latching surface 73 opposite the latching projection 76.

As described above, the operating projections 70 and 71 of the trip link 12 are separated angularly by a space substantially wider than the angular width of the adjoining-pole operating projection 69. In a multi-pole breaker, as shown diagrammatically in FIG. 6A, adjoining poles have similar trip links 112 and 212, the projection 69 projecting into the space between projections 170 and 171, and a projection 269 projecting into the space between projections 70 and 71. While the trip link 12 is pivoting counterclockwise to unlatch the latch 42 there is no load on this trip link due to the interconnection to the adjoining pole trip links 112 and 212. After the latch 42 has unlatched, one or both of the surfaces 62 and 64 will engage the opposed surfaces on the projections 170 and 269 of the adjoining poles, if they are not already tripping due to the event which is tripping this pole. Thus inter-pole tripping is achieved without slowing the tripping of this pole or need for another part.

Fast magnetic tripping

If the current through the solenoid 10 suddenly rises to a very high value, for example as a result of a short circuit, the solenoid force produced will be above that which is just sufficient to overcome the solenoid spring 93; and in preferred configurations and ratings of the breaker, far above the minimum for magnetic tripping. This causes the armature 92 of the solenoid to develop a very high saturation force, and to accelerate to speeds exceeding those equivalent to the crank and contact speeds occurring as described above.

Under these circumstances, after the actuating disc 54 has struck and pivoted the trip link sufficiently to unlatch the latch 42, the disc will engage the contact arm 18 between the contact arm pivot pin 36 and the movable contact 28, and will overcome the torque applied by the contact pressure spring 82 and directly pivot the contact arm 18 counterclockwise, opening the contact set 13. This occurs before the crank has accelerated and moved very far under the influence of the mechanism spring 78.

A special advantage of the contact arm, crank and pressure spring arrangement disclosed is that, under fast tripping, the rotation of the contact arm 18 causes the spring end 85 to slip onto the end edge 84 of the arm, reversing the torque so that the movable contact 28 is held away from the fixed contact 27 until the crank 38 and the rest of the operating mechanism have time to reach the final open position, ready for resetting.

Manual Opening

Manual operation of the handle 34, moving the handle to the left as seen in FIG. 1, removes the reaction force holding the crank 38 in the closed position. Under the force of the mechanism spring 78, the crank pivots counterclockwise until the nose 140 of the contact arm 18 strikes the inside surface 142 of the crank, and further crank movement opens the contact set 13. The latch 42 will pivot counterclockwise about the point of contact between the latching projection 76 and the latching surface 73 of the trip link 12, leaving the mechanism in condition for closing.

Resetting/Closing

Regardless of the type of tripping or opening cycle, the final position leaves the handle in the open position, fully counterclockwise; the remote end of the contact arm 18 pressing against the corner 104 of the solenoid frame, with the nose 140 at the other end of the arm 18 pressing against the surface 142, and the latching projection 76 adjacent the latching surface 73. Closing movement of the handle 34 causes the handle link 35 to push the latching projection 76 up against the latching surface 73, and then to pivot the latch 42 clockwise about the point of latching engagement, thereby pivoting the latch and contact pivot pin 36, and with it, the crank 38, clockwise about the mechanism pivot pin 40. As the crank pivots, the nose 140 of the contact arm 18 is released from engagement with the inside surface 142 when the movable contact 28 engages the fixed contact 27, and normal contact pressure due to the contact pressure spring 82 is applied.

Solenoid Setting

The solenoid embodiment disclosed herein is just one of many which can utilize this invention aspect. The solenoid 10 is a subassembly of a type suitable for use in other mechanisms besides circuit breakers. The magnetic trip level or current sensitivity (for non-breaker applications) can be easily and accurately set after the device is assembled. One technique which may be used is to apply a current to the coil 16 equal to the desired trip level prior to bending the stop rod 99. Through capturing the actuating disc 54 in a jig, the position of the armature can be controlled to move it to the position where the magnetic pull just equally the force of the spring 93. While holding the armature 92 in that position, the end 100 of the stop rod is bent over in contact with the end 101 of the bobbin extension 95, establishing the setting through plastic deformation of the stop rod.

Booster Loop/Arc Runner Operation

FIG. 8 shows three stages of current flow through the breaker: contact set 13 closed, contacts opened but arc not yet accelerated toward the arc chute 19, and arc transferred from the fixed contact 27 to the arc runner 22 and partially blown toward the arc chute.

Current flow prior to contact opening is conventional: from the line terminal connection 15, through the bi-metal strip 14 and strap 26 to the fixed contact 27, and from the movable contact 28 through the contact arm 18 and strap 29 to the solenoid coil 16, through the coil to the load terminal connection 17. When the contacts have first opened the only change in path is that, if the current is high enough to sustain a short arc, an arc 150 is established between the contacts 27 and 28. This causes current to flow around three sides of a region 152.

According to well-known principles of electromagnetism, the magnetic field generated around and in the region 152 causes a force urging the arc outward—that is, toward the space 154. As a result, the arc stretches downward as viewed in FIG. 8, and transfers from the fixed contact 27 to the arc runner 22. This causes the current to follow a new path: from the line terminal connection 15 directly to the booster loop end 126, along the booster loop 21 portion to the end 124 adjacent the rear of the arc chute 19, and then back up, in the opposite direction, along the arc runner 22 to the location of instantaneous termination of the arc path 156; and across the space between the runner and the movable contact arm 18.

The curved end of the movable contact arm 18 is selected to cause the arc hot spot to travel from the point of normal conductive contact with the fixed contact 27, moving continuously toward the extreme end until the arc breaks spontaneously (relatively low currents) or is blown into the arc chute 19 and interrupted.

The connections and configuration of the arc runner and booster loop element 20 provide significant performance advantages over prior known circuit breakers: First, as the arc termination travels along the runner, the impedance drops. As a result the force accelerating the arc toward the arc chute increases, and the arc is extinguished faster than with prior art breakers. Second, the overcurrent is quickly diverted from the path through the bi-metal strip 14, so that the calibration of this strip is more consistent.

Alternative Embodiments

It will be clear to those of ordinary skill in the art, that the adjustment feature of the solenoid mechanism disclosed herein could also be utilized in a magnetic device such as a relay, having a clapper rather than a central core armature. Use of the adjustable central stop rod allows adjustment without exchanging springs and without having unbalanced lateral forces which cause irregular friction, and thus inconsistent calibration.

The various elements of the latch and trip mechanism can be utilized independent of each other. For example, the trip link can be used in a single pole breaker, with the axial projections operating a different function. The crank and contact pressure spring arrangement provide important performance advantages independent of the trip link, because the contact pressure spring also aids in opening the contacts and holding them open during fast magnetic tripping.

Thus the scope of the invention includes any embodiments falling within the appended claims.

We claim:

1. A circuit breaker comprising:

a contact set having first and second contacts, forming an electrical switch, means for mounting said second contact for movement with respect to said first contact between a closed position and an open position, a latching mechanism for holding said second contact in said closed position, said latching mechanism comprising a latch element, a tripping mechanism for unlatching the latching mechanism, said tripping mechanism comprising at least one actuator which moves from a normal position to a tripping position in response to occurrence of a given condition, and an additional element, and means for mounting said additional element for movement between a normal and an actuating position, characterized in that said tripping mechanism further comprises a trip link mounted for pivotal movement about an axis between a latched position and at least one unlatched position, said trip link comprising:

a center hub, a latching surface which forms part of said latching mechanism, arranged adjacent said hub for engagement by said latch element for holding said second contact in said closed position, a sensing arm extending generally radially from said hub, arranged for engagement by said actuator upon movement of said actuator from said normal position to said tripping position, to pivot said trip link from the latched position to a first unlatched position in which said latching surface is disengaged from said latch thereby releasing said latching mechanism, and at least one operating projection extending from said hub, in said latched position said projection being spaced from said additional element, and upon pivoting of said trip link from said first unlatched position to a further unlatched position, said operating projection engaging and moving said additional element, whereby force requirements for moving said trip link from said latched to said first unlatched position are free from force requirements for moving said additional element.

2. A circuit breaker as claimed in claim 1, comprising a contact pressure spring arranged to press said second contact against said first contact when said contacts are in said closed contact position, and means for moving said second contact from said closed position to said open position responsive to unlatching of said latching mechanism by said tripping mechanism, characterized in that the breaker further comprises means, in addition to said means for moving, for forcing said second contact rapidly away from said first contact toward said open contact position in response to occurrence of a high overload current, and means for causing said contact pressure spring to urge said second contact away from said first contact, responsive to movement of said said second contact by said means for forcing.

3. A circuit breaker comprising:

a contact set having first and second contacts, forming an electrical switch, means for mounting said second contact for movement with respect to said first contact between a closed position and an open position, a latching mechanism for holding said second contact in said closed position, said latching mechanism comprising a latch element, a tripping mechanism for unlatching the latching mechanism, said tripping mechanism comprising at least one actuator which moves from a normal position to a tripping position in response to occurrence of a given condition, a contact pressure spring arranged to press said second contact against said first contact when said contacts are in said closed contact position, and means for moving said second contact from said closed position to said open position responsive to unlatching of said latching mechanism by said tripping mechanism, characterized in that the breaker further comprises means, in addition to said means for moving, for forcing said second contact rapidly away from said first contact toward said open contact position in response to occurrence of a high overload current, and means for causing said contact pressure spring to urge said second contact away from said first contact, responsive to movement of said said second contact by said means for forcing.

4. A multi-pole circuit breaker, comprising a plurality of poles having respective contacts, and means for interconnecting said poles such that opening the contacts of one pole causes opening of the respective contacts of the other poles, wherein each pole comprises:

first and second contacts, forming an electrical switch, means for mounting said second contact for movement with respect to said first contact between a closed position and an open position, a latching mechanism for holding said second contact in said closed position, said latching mechanism comprising a latch element, a tripping mechanism for unlatching the latching mechanism, said tripping mechanism comprising at least one actuator which moves from a normal position to a tripping position in response to occurrence of a given condition, and a tripping element arranged for engagement by an inter-pole tripping device of an adjoining pole, said tripping element and tripping device each being part of said means for interconnecting, characterized in that said tripping mechanism further comprises a trip link mounted for pivotal movement about an axis between a latched position and at least one unlatched position, said trip link comprising:

a center hub, a latching surface which forms part of said latching mechanism, arranged adjacent said hub for engagement by said latch element for holding said second contact in said closed position, a sensing arm extending generally radially from said hub, arranged for engagement by said actuator upon movement of said actuator form said normal position to said tripping position, to pivot said trip link from the latched position to a first unlatched position in which said latching surface is disengaged from said latch thereby releasing said latching mechanism, and at least one operating projection extending from said hub, forming said tripping element, in said latched position said projection being spaced from said tripping device, and upon pivoting of said trip link from said first unlatched position to a further unlatched position, said operating projection engaging and moving said tripping device, whereby force requirements for moving said trip link from said latched to said first unlatched position are free from force requirements for moving said tripping device.

5. A breaker as claimed in claim 1, characterized in that said additional element forms part of means for actuating a device which is independent of said contact set, latching mechanism and tripping mechanism.

6. A breaker as claimed in claim 1, characterized in that said additional element forms part of a tripping mechanism of an adjoining pole of said breaker.

7. A circuit breaker as claimed in claim 4, comprising a contact pressure spring arranged to press said second contact against said first contact when said contacts are in said closed contact position, and means for moving said second contact from said closed position to said open position responsive to unlatching of said latching mechanism by said tripping mechanism, characterized in that the breaker further comprises means, in addition to said means for moving, for forcing said second contact rapidly away from said first contact toward said open contact position in response to occurrence of a high overload current, and means for causing said contact pressure spring to urge said second contact away form said first contact, responsive to movement of said said second contact by said means for forcing.

8. A breaker as claimed in claim 4, wherein said trip link moves through a given angular distance form said latched position to said first unlatched position, characterized in that said at least one operating projection, in one of said poles, extends in one axial direction from said hub, is spaced radially from said axis a given radial distance, and has a given angular width, and the inter-pole tripping device of said adjoining pole comprises two operating projections extending axially from the hub of that adjoining pole's trip link in a direction opposite said one direction, spaced radially from said axis a distance substantially equal said given radial distance, and spaced from each other an angular distance greater than said given angular width by at least said given angular distance, said at least one operating projection of said one of said poles is disposed between said two operating projections, whereby, in response to pivoting of said trip link in said one of said poles from the latched position past the first unlatched position to a further unlatched position, said at least one operating projection engages one of said two operating projections to pivot said adjoining pole's trip link form its latched to its first unlatched position; and in response to pivoting of said adjoining pole's trip link from its latched position past its first unlatched position to its further unlatched position, said at least one operating projection is engaged by the other of said two operating projections to pivot said one pole's trip link from its latched to its first unlatched position.

* * * * *